US011810517B2

(12) United States Patent
Park et al.

(10) Patent No.: US 11,810,517 B2
(45) Date of Patent: Nov. 7, 2023

(54) DISPLAY DEVICE HAVING A PLURALITY OF NON-EMISSION PERIODS AND DRIVING METHOD THEREOF

(71) Applicant: Samsung Display Co., LTD., Yongin-si (KR)

(72) Inventors: Kyoung Jin Park, Yongin-si (KR); Yang Wan Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/860,110

(22) Filed: Jul. 8, 2022

(65) Prior Publication Data

US 2023/0032883 A1 Feb. 2, 2023

(30) Foreign Application Priority Data

Jul. 28, 2021 (KR) ..... 10-2021-0099455

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2310/0278* (2013.01)

(58) Field of Classification Search
CPC ..... G09G 3/3266
USPC ..... 345/82
See application file for complete search history.

(56) References Cited

U.S. PATENT DOCUMENTS

| | | | | |
|---|---|---|---|---|
| 10,672,338 | B2 | 6/2020 | Lin et al. | |
| 10,916,198 | B2 | 2/2021 | Lin et al. | |
| 11,238,786 | B2 | 2/2022 | Byun et al. | |
| 2020/0226978 | A1* | 7/2020 | Lin | G09G 3/3258 |
| 2021/0134210 | A1* | 5/2021 | In | G09G 3/2092 |
| 2021/0201764 | A1* | 7/2021 | Oh | G09G 3/32 |

FOREIGN PATENT DOCUMENTS

| | | |
|---|---|---|
| KR | 10-2212927 | 2/2021 |
| KR | 10-2281222 | 7/2021 |

* cited by examiner

*Primary Examiner* — Long D Pham
(74) *Attorney, Agent, or Firm* — H.C. Park & Associates, PLC

(57) ABSTRACT

A display device includes a pixel having a first transistor connected between first and second nodes to generate a driving current; an emission driver that supplies an emission control signal including an off-duty corresponding to first and second gate-off periods to an emission control line during a frame period; a scan driver that supplies first to fourth scan signals to the first to fourth scan lines in a first non-emission period, respectively, and that supplies the first scan signal to the first scan line in a second non-emission period; a data driver that supplies a data signal to the data line; and a controller adjusting the off-duty of the emission control signal that is a width of each of the first and second non-emission periods in response to a dimming signal, and that controls a timing at which the first scan signal is supplied in the second non-emission period.

20 Claims, 10 Drawing Sheets

DISPLAY DEVICE HAVING A PLURALITY OF NON-EMISSION PERIODS AND DRIVING METHOD THEREOF

CROSS REFERENCE TO RELATED APPLICATION

The application claims priority from and the benefit of Korean Patent Application No. 10-2021-0099455, filed Jul. 28, 2021, which is hereby incorporated by reference for all purposes as if fully set forth herein.

BACKGROUND

Field

Embodiments of the invention relate generally to a display device and a method of driving the same.

Discussion of the Background

A display device displays an image using control signals applied from outside.

The display device includes a plurality of pixels. Each of the pixels includes a plurality of transistors, a light emitting element electrically connected to the transistors, and a capacitor. The transistors generate a driving current based on signals provided through signal lines, and the light emitting element emits light based on the driving current.

The above information disclosed in this Background section is only for understanding of the background of the inventive concepts, and, therefore, it may contain information that does not constitute prior art.

SUMMARY

Devices constructed and methods performed according to illustrative implementations of the invention are capable of improving image quality of a display device by reducing a parasitic capacitor coupling between one or more components of the display device.

Inventive concepts consistent with at least one embodiment of the invention provide for a display device that controls an off-duty of an emission control signal and a supply timing of a first scan signal according to a dimming signal.

Another inventive concept consistent with at least one embodiment of the invention provides a method of driving the display device.

Additional features of the inventive concepts will be set forth in the description that follows, and in part will be apparent from the description, or may be learned by practice of the inventive concepts.

In order to achieve at least one of the inventive concepts, a display device according to one or more embodiments may include a pixel including a first transistor connected between a first node and a second node to generate a driving current, and connected to a first scan line, a second scan line, a third scan line, a fourth scan line, an emission control line, and a data line; an emission driver supplying an emission control signal including an off-duty corresponding to a first gate-off period and a second gate-off period to the emission control line during a frame period; a scan driver supplying first, second, third, and fourth scan signals to the first, second, third and fourth scan lines in a first non-emission period, respectively, and supplying the first scan signal to the first scan line in a second non-emission period; a data driver supplying a data signal to the data line; and a controller adjusting the off-duty of the emission control signal that is a width of each of the first and second non-emission periods in response to a dimming signal, and controlling a timing at which the first scan signal is supplied in the second non-emission period. The first gate-off period may correspond to the first non-emission period and the second gate-off period may correspond to the second non-emission period.

According to an embodiment, the dimming signal may include a dimming value indicating a maximum display luminance that the display device can emit light. The maximum display luminance may increase and the off-duty may decrease as the dimming value increases.

According to an embodiment, the controller may determine a supply time point of the first scan signal in conjunction with a start time point of the second non-emission period.

According to an embodiment, a time interval between the start time point of the second non-emission period and the supply time point of the first scan signal in the second non-emission period may be substantially constant.

According to an embodiment, an output timing of the first scan signal in the second non-emission period of the frame period may become earlier as the off-duty increases.

According to an embodiment, within each frame period of the same driving frequency, an end time point of the second non-emission period with respect to a first off-duty may be the same as an end time point of the second non-emission period with respect to a second off-duty, and an end time point of the first non-emission period with respect to the first off-duty may be the same as an end time point of the first non-emission period with respect to the second off-duty.

According to an embodiment, a time interval between the supply time point of the first scan signal in the second non-emission period and the end time point of the second non-emission period may increase as the off-duty increases.

According to an embodiment, the pixel may further include a light emitting element; a second transistor connected between the data line and the first node and turned on in response to the fourth scan signal supplied to the fourth scan line; a third transistor connected between the second node and a third node connected to a gate electrode of the first transistor and turned on in response to the second scan signal supplied to the second scan line; a fourth transistor turned on in response to the first scan signal supplied to the first scan line to apply a voltage of a first power source to the first transistor; a fifth transistor connected between a driving power source and the first node and turned off during the first and second gate-off periods of the emission control signal supplied to the emission control line; and a sixth transistor connected between the second node and a first electrode of the light emitting element and turned off during the first and second gate-off periods of the emission control signal supplied to the emission control line.

According to an embodiment, in the first non-emission period, the scan driver may supply the first scan signal and the second scan signal to the first scan line and the second scan line a plurality of times, respectively.

According to an embodiment, a pulse width of the first scan signal supplied in the second non-emission period may be greater than a pulse width of the first scan signal supplied in the first non-emission period.

According to an embodiment, an interval at which the first scan signal is supplied in the first non-emission period may increase as the off-duty increases.

According to an embodiment, the pixel may further include a seventh transistor connected between the third node and a second power source and turned on in response to the third scan signal supplied to the third scan line; and an eighth transistor connected between the first electrode of the light emitting element and a third power source and turned on in response to the first scan signal.

According to an embodiment, the scan driver may supply the second scan signal to the second scan line in a first period and a third period of the first non-emission period, and supply the third scan signal to the third scan line in a second period of the first non-emission period. The second period may begin between the first period and the third period.

According to an embodiment, the scan driver may supply the fourth scan signal to the fourth scan line to overlap a portion of the second scan signal in the third period.

According to an embodiment, the scan driver may supply the first scan signal to the first scan line in the first period and a fourth period after the third period.

According to an embodiment, after the fourth period, the supply of the first, second, third, and fourth scan signals may be stopped during a remaining period of the first non-emission period, and a length of the remaining period may be greater than a width of the first scan signal.

According to an embodiment, a first time interval between an end time point of the second non-emission period and a supply time point of the first scan signal in the second non-emission period may be substantially constant, a second time interval between a start time point of the second non-emission period and the supply time point of the first scan signal in the second non-emission period may increase as the off-duty increases, and the second time interval may be greater than the first time interval.

According to an embodiment, the scan driver may include a first scan driver supplying the first scan signal to the first scan line in the first non-emission period and the second non-emission period; a second scan driver supplying the second scan signal to the second scan line a plurality of times in the first non-emission period; a third scan driver supplying the third scan signal to the third scan line between supplies of the second scan signal in the first non-emission period; and a fourth scan driver supplying the fourth scan signal to the fourth scan line to overlap the portion of the second scan signal.

In order to achieve at least one of the inventive concepts, a method of driving a display device including a first non-emission period and a second non-emission period during a frame period according to embodiments may include determining an off-duty of an emission control signal that is a width of each of the first non-emission period and the second non-emission period based on a dimming value included in a dimming signal; supplying first, second, third, and fourth scan signals to first, second, third, and fourth scan lines in the first non-emission period, respectively, and writing a data signal; and supplying the first scan signal to the first scan line within the second non-emission period in conjunction with a start time point of the second non-emission period.

According to an embodiment, a time interval between the start time point of the second non-emission period and a supply time point of the first scan signal in the second non-emission period may be substantially constant, and an output timing of the first scan signal in the second non-emission period of the frame period may become earlier as the off-duty increases.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the inventive concepts, and are incorporated in and constitute a part of this specification, illustrate embodiments of the inventive concepts, and, together with the description, serve to explain principles of the inventive concepts.

DETAILED DESCRIPTION

Figure 1:
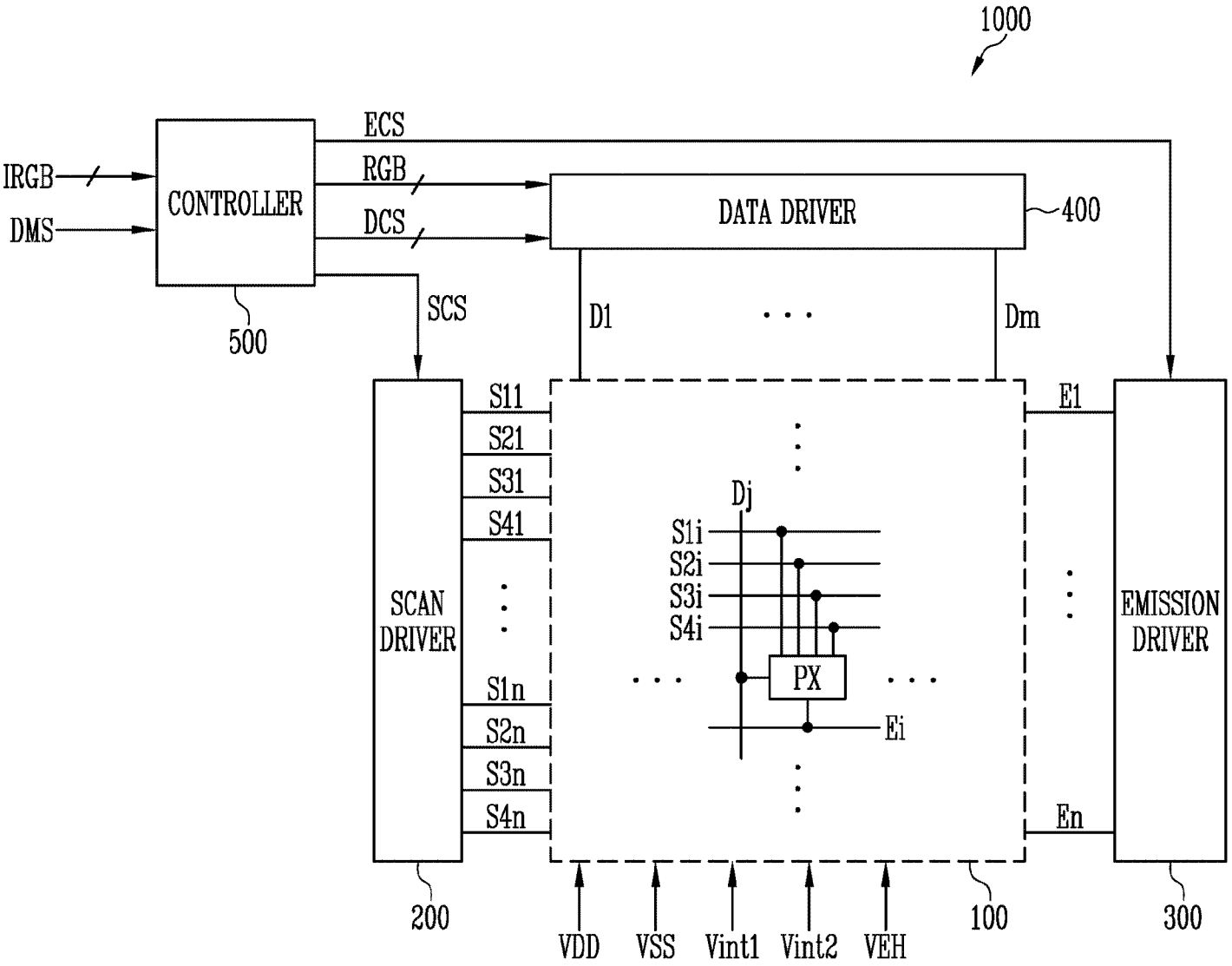
FIG. 1 is a diagram illustrating a display device according to one or more embodiments and that is constructed according to principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, preferred embodiments of the present invention will be described in more detail with reference to the accompanying drawings. The same reference numerals are used for the same elements in the drawings, and duplicate descriptions for the same elements are omitted for sake of brevity.

FIG. 1 is a diagram illustrating a display device according to one or more embodiments and that is constructed according to principles of the invention.

Referring to FIG. 1, a display device 1000 may include a pixel unit 100, a scan driver 200, an emission driver 300, a data driver 400, and a controller 500.

The display device 1000 may display an image at various frame frequencies (refresh rate, driving frequency, or screen refresh rate) according to driving conditions. A frame frequency may be a frequency at which a data voltage is substantially written to a driving transistor of a pixel PX for one second. For example, the frame frequency may also be referred to as a refresh rate or a screen refresh rate, and may indicate a frequency at which a display screen is reproduced for one second.

In an embodiment, an output frequency of a fourth scan signal supplied to a fourth scan line S4*i* to supply a data signal to the pixel PX may be changed corresponding to the frame frequency. For example, the frame frequency for driving a moving image may be a frequency of about 60 Hz or higher (for example, 60 Hz, 120 Hz, or 240 Hz). When the frame frequency is 60 Hz, the fourth scan signal may be supplied 60 times per second to each horizontal line (pixel row).

In an embodiment, the display device 1000 may adjust output frequencies of the scan driver 200 and the emission driver 300 and an output frequency of the data driver 400 corresponding thereto according to driving conditions. For example, the display device 1000 may display the image corresponding to various frame frequencies of 1 Hz to 120 Hz. However, this is an example, and the display device 1000 may also display the image at the frame frequency of 120 Hz or higher (for example, 240 Hz or 480 Hz).

The pixel unit 100 may include scan lines S11 to S1*n*, S21 to S2*n*, S31 to S3*n*, and S41 to S4*n*, emission control lines E1 to En, data lines D1 to Dm, and pixels PX connected to the scan lines S11 to S1*n*, S21 to S2*n*, S31 to S3*n*, and S41 to S4*n*, the emission control lines E1 to En, and the data lines D1 to Dm, where m and n may be integers greater than 1. Each of the pixels PX may include a driving transistor and a plurality of switching transistors.

The controller 500 may receive input image data IRGB, a dimming signal DMS, and control signals from a host system such as an application processor (AP) through a predetermined interface. The controller 500 may include a timing controller for controlling driving timings of the scan driver 200, the emission driver 300, and the data driver 400.

The controller 500 may generate a first control signal SCS, a second control signal ECS, and a third control signal DCS based on the input image data IRGB, the control signals, a clock signal, and the like. The first control signal SCS may be supplied to the scan driver 200, the second control signal ECS may be supplied to the emission driver 300, and the third control signal DCS may be supplied to the data driver 400. The controller 500 may rearrange the input image data IRGB and supply the rearranged input image data to the data driver 400.

In an embodiment, the controller 500 may further control generation of the first control signal SCS and the second control signal ECS based on the dimming signal DMS. The dimming signal DMS may include a dimming value indicating a maximum display luminance that the display device 1000 (and the pixel unit 100) can emit light. For example, as the dimming value increases, the maximum display luminance that can be displayed in the pixel unit 100 may increase. The maximum display luminance may be a luminance measured when the entire pixel unit 100 emits light with a maximum grayscale set in the display device 1000.

In an embodiment, the controller 500 may adjust an off-duty (also referred to in the art as "off-duty cycle") of an emission control signal in response to the dimming signal DMS. For example, the second control signal ECS may include an emission control start signal, and a gate-off period of the emission control start signal may be adjusted based on the dimming signal DMS. The emission driver 300 may output the emission control signal whose off-duty (or gate-off period) is adjusted based on the emission control start signal. For example, when the dimming value included in the dimming signal DMS decreases (that is, when the maximum display luminance decreases), the gate-off period of the emission control start signal (and the emission control signal) may increase.

In an embodiment, the controller 500 may adjust a supply timing of a first scan signal in response to the dimming signal DMS. For example, the first control signal SCS may include a first scan start signal, and an output timing of the first scan start signal may be determined based on the dimming signal DMS. The scan driver 200 may output the first scan signal based on the first scan start signal.

The scan driver 200 may receive the first control signal SCS from the controller 500, and supply the first scan signal, a second scan signal, a third scan signal, and the fourth scan signal to first scan lines S11 to S1*n*, second scan lines S21 to S2*n*, third scan lines S31 to S3*n*, and fourth scan lines S41 to S4*n*, respectively, based on the first control signal SCS.

The first, second, third, and fourth scan signals may be set to a gate-on voltage corresponding to a type of a transistor to which a corresponding scan signal is supplied. The transistor receiving the scan signal may be set to a turned-on state when the scan signal is supplied. For example, the gate-on voltage of the scan signal supplied to a P-channel metal oxide semiconductor (PMOS) transistor may be at a logic low level, and the gate-on voltage of the scan signal supplied to an N-channel metal oxide semiconductor (NMOS) transistor may be at a logic high level. Hereinafter, the expression "the scan signal is supplied" may be understood as being supplied to a logic level at which the scan signal turns on a transistor controlled thereby.

In an embodiment, the scan driver 200 may supply some of the first, second, third, and fourth scan signals a plurality of times during a non-emission period. Accordingly, the bias state of the driving transistor included in the pixel PX may be controlled.

The emission driver 300 may supply the emission control signal to the emission control lines E1 to En based on the second control signal ECS. For example, the emission control signal may be sequentially supplied to the emission control lines E1 to En.

The emission control signal may be set to a gate-off voltage (for example, a high voltage). A transistor receiving the emission control signal may be turned off when the emission control signal is supplied, and may be set to a turned-on state in other cases. Hereinafter, the expression "the emission control signal is supplied" may be understood as being supplied to a logic level at which the emission control signal turns off a transistor controlled thereby.

In FIG. 1, for convenience of explanation, the scan driver 200 and the emission driver 300 are shown as independent configurations, but the present invention is not limited thereto. According to a design, the scan driver 200 may include a plurality of scan drivers that respectively supply at least one of the first, second, third, and fourth scan signals. In addition, at least a portion of the scan driver 200 and the emission driver 300 may be integrated into one driving circuit, module, or the like.

The data driver 400 may receive the third control signal DCS and image data RGB from the controller 500. The data driver 400 may convert the image data RGB in a digital format into an analog data signal (data voltage). The data driver 400 may supply the data signal to the data lines D1 to Dm in response to the third control signal DCS. In this case, the data signal supplied to the data lines D1 to Dm may be supplied to be synchronized with the fourth scan signal supplied to the fourth scan lines S41 to S4*n*.

In an embodiment, the display device 1000 may further include a power supply. The power supply may supply a voltage of a first driving power source VDD, a voltage of a second driving power source VSS, a voltage of a first power source VEH (or a bias power source), a voltage of a second power source Vint1 (or a first initialization power source), and a voltage of a third power source Vint2 (or a second initialization power source) to the pixel unit 100 to drive the pixel PX.

The display device 1000 may operate at various frame frequencies. When driving at a low frequency, image defects such as flicker may be visually recognized due to leakage current inside the pixel PX. In addition, by driving at various frame frequencies, an afterimage such as image dragging may be visually recognized according to a change in response speed due to a threshold voltage shift according to changes in the bias state and hysteresis characteristic of the driving transistor.

In order to improve image quality, one frame period of the pixel PX may include a plurality of non-emission periods according to the frame frequency. For example, the initial non-emission period of the frame may include a display scan period, and a non-emission period thereafter may be a bias scan period.

The data signal for substantially displaying the image may be written into the pixel PX during the display scan period, and an on-bias may be applied to the driving transistor of the pixel PX during the bias scan period.

Figure 2:
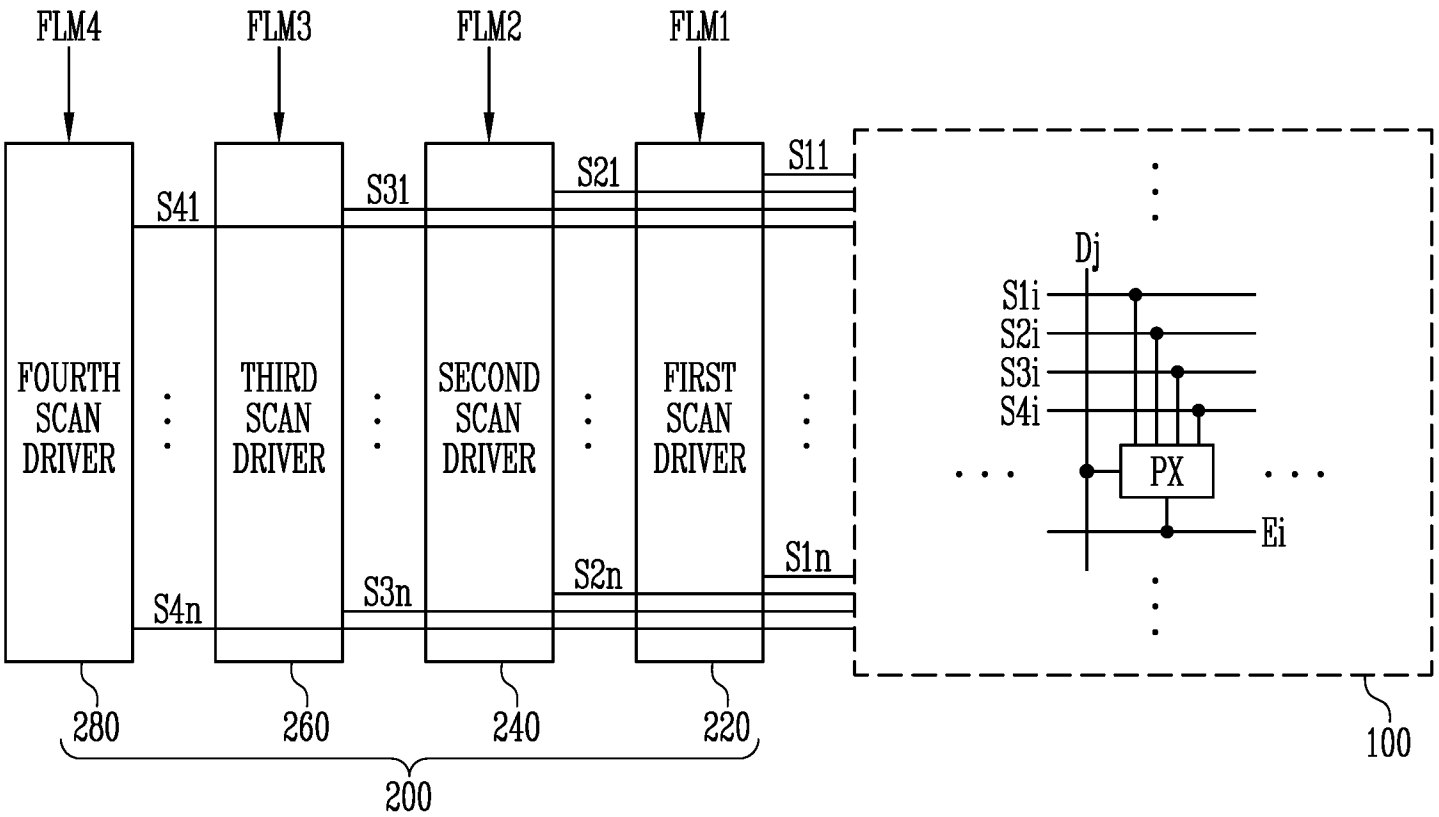
FIG. 2 is a diagram illustrating an example of a scan driver included in the display device of FIG. 1.

FIG. 2 is a diagram illustrating an example of a scan driver included in the display device of FIG. 1.

Referring to FIGS. 1 and 2, the scan driver 200 may include a first scan driver 220, a second scan driver 240, a third scan driver 260, and a fourth scan driver 280.

The first control signal SCS may include first, second, third, and fourth scan start signals FLM1 to FLM4. The first, second, third, and fourth scan start signals FLM1 to FLM4 may be supplied to the first, second, third, and fourth scan drivers 220, 240, 260, and 280, respectively.

Widths, supply timings, and the like of the first, second, third, and fourth scan start signals FLM1 to FLM4 may be determined according to a driving condition of the pixel PX and the frame frequency. For example, at least one of the first, second, third, and fourth scan start signals FLM1 to FLM4 may be determined based on the dimming signal DMS.

In an embodiment, a supply timing of the first scan start signal FLM1 within a frame period may be changed according to a change in off-duty of the emission control signal determined based on the dimming signal DMS.

The first, second, third, and fourth scan signals may be output based on the first, second, third, and fourth scan start signals FLM1 to FLM4, respectively. For example, a width of at least one of the first, second, third, and fourth scan signals may be different from a width of the other signals.

The first scan driver 220 may sequentially supply the first scan signal to the first scan lines S11 to S1*n* in response to the first scan start signal FLM1. The second scan driver 240 may sequentially supply the second scan signal to the second scan lines S21 to S2*n* in response to the second scan start signal FLM2. The third scan driver 260 may sequentially supply the third scan signal to the third scan lines S31 to S3*n* in response to the third scan start signal FLM3. The fourth scan driver 280 may sequentially supply the fourth scan signal to the fourth scan lines S41 to S4*n* in response to the fourth scan start signal FLM4.

Figure 3:
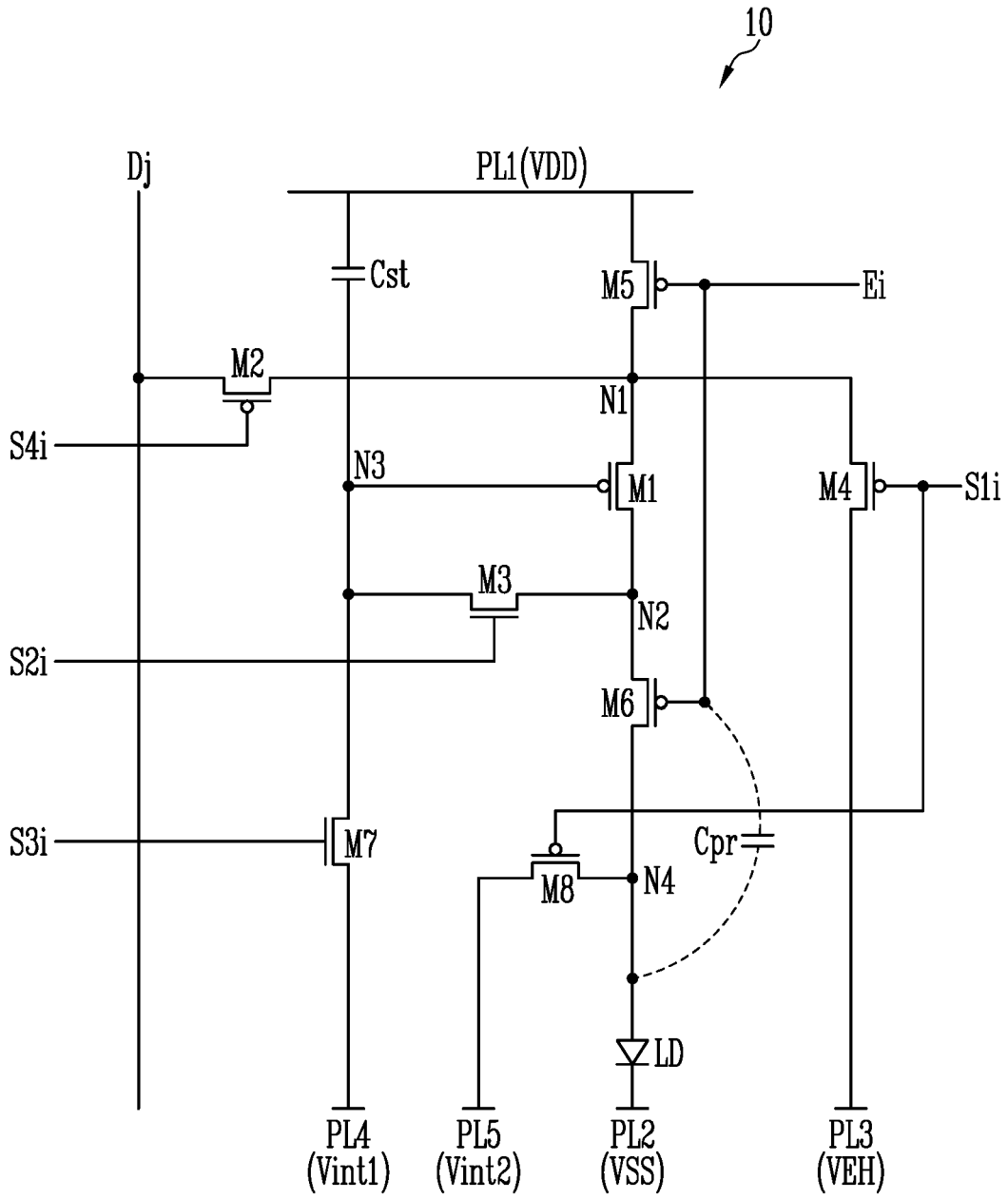
FIG. 3 is a circuit diagram illustrating an example of a pixel included in the display device of FIG. 1.

FIG. 3 is a circuit diagram illustrating an example of a pixel included in the display device of FIG. 1.

In FIG. 3, for convenience of explanation, a pixel 10 positioned on an i-th horizontal line (or an i-th pixel row) and connected to a j-th data line Dj is shown, where i and j may be natural numbers.

Referring to FIGS. 1 and 3, the pixel 10 may include a light emitting element LD, first to eighth transistors M1 to M8, and a storage capacitor Cst.

A first electrode (anode electrode or cathode electrode) of the light emitting element LD may be connected to the sixth transistor M6, and a second electrode (cathode electrode or anode electrode) may be connected to a second power source line PL2 to which the second driving power source VSS is supplied. The light emitting element LD may generate light with a predetermined luminance in response to the amount of current supplied from the first transistor M1.

In an embodiment, the light emitting element LD may be an organic light emitting diode including an organic light emitting layer. In another embodiment, the light emitting element LD may be an inorganic light emitting element formed of an inorganic material. In another embodiment, the light emitting element LD may be a light emitting element composed of an inorganic material and an organic material in combination. Alternatively, the light emitting element LD may have a form in which a plurality of inorganic light emitting elements are connected in parallel and/or in series between the second power source line PL2 and the sixth transistor M6.

A first electrode of the first transistor M1 (or a driving transistor) may be connected to a first node N1, and a second electrode may be connected to a second node N2. A gate electrode of the first transistor M1 may be connected to a third node N3. The first transistor M1 may control the amount of current flowing from the first driving power source VDD to the second driving power source VSS via the light emitting element LD in response to a voltage of the third node N3. To this end, the first driving power source VDD may be set to a voltage higher than the second driving power source VSS.

The second transistor M2 may be connected between the j-th data line Dj (hereinafter, referred to as a data line) and the first node N1. A gate electrode of the second transistor M2 may be connected to an i-th fourth scan line S4*i* (hereinafter, referred to as a fourth scan line). The second transistor M2 may be turned on when the fourth scan signal is supplied to the fourth scan line S4*i* to electrically connect the data line Dj and the first node N1.

The third transistor M3 may be connected between the second electrode of the first transistor M1 (that is, the second node N2) and the third node N3. A gate electrode of the third transistor M3 may be connected to an i-th second scan line S2*i* (hereinafter, referred to as a second scan line). The third transistor M3 may be turned on when the second scan signal is supplied to the second scan line S2*i* to electrically connect the second electrode of the first transistor M1 and the third node N3. That is, a timing at which the second electrode (for example, a drain electrode) of the first transistor M1 and the gate electrode of the first transistor M1 are connected by the second scan signal may be controlled. When the third transistor M3 is turned on, the first transistor M1 may be connected in the form of a diode.

The fourth transistor M4 may be turned on in response to the first scan signal supplied to an i-th first scan line S1*i* (hereinafter, referred to as a first scan line) to supply a voltage of the first power source VEH to the first transistor M1. In an embodiment, the fourth transistor M4 may be connected between the first node N1 and a third power source line PL3 to which the first power source VEH is supplied. Here, a timing at which the voltage of the first power source VEH is supplied to the first node N1 by the first scan signal may be controlled.

A gate electrode of the fourth transistor M4 may be connected to the first scan line S1*i*. When the fourth transistor M4 is turned on, the voltage of the first power source VEH may be supplied to the first node N1. In an embodiment, the voltage of the first power source VEH may be at a level similar to the data voltage of a black grayscale. For example, the voltage of the first power source VEH may be about 5V to 7V.

Accordingly, as the fourth transistor M4 is turned on, a predetermined high voltage may be applied to a source electrode of the first transistor M1. In this case, if the third transistor M3 is in a turned-off state, the first transistor M1 may have an on-bias state (a state capable of being turned on) (that is, an on-biased state).

The fifth transistor M5 may be connected between the first power source line PL1 transmitting the first driving power source VDD and the first node N1. A gate electrode of the fifth transistor M5 may be connected to an i-th emission control line Ei (hereinafter, referred to as an emission control line). The fifth transistor M5 may be turned off when the emission control signal is supplied to the emission control line Ei, and may be turned on in other cases.

The sixth transistor M6 may be connected between the second electrode of the first transistor M1 (that is, the second node N2) and the first electrode of the light emitting element LD (that is, a fourth node N4). A gate electrode of the sixth transistor M6 may be connected to the emission control line Ei. The sixth transistor M6 may be controlled substantially the same as the fifth transistor M5.

The seventh transistor M7 may be connected between the third node N3 and a fourth power source line PL4 transmitting the second power source Vint1 (hereinafter, referred to as the first initialization power source). A gate electrode of the seventh transistor M7 may be connected to an i-th third scan line S3*i*. The seventh transistor M7 may be turned on when the third scan signal is supplied to the third scan line S3*i* to supply a voltage of the first initialization power source Vint1 to the third node N3. Here, the voltage of the first initialization power source Vint1 may be set to be lower than that of the data signal supplied to the data line Dj. Accordingly, as the seventh transistor M7 is turned on, a gate voltage of the first transistor M1 may be initialized to the voltage of the first initialization power source Vint1.

The eighth transistor M8 may be connected between the first electrode of the light emitting element LD (that is, the fourth node N4) and a fifth power source line PL5 transmitting the third power source Vint2 (hereinafter, referred to as the second initialization power source). In an embodiment, a gate electrode of the eighth transistor M8 may be connected to the first scan line S1*i*. The eighth transistor M8 may be turned on when the first scan signal is supplied to the first scan line S1*i* to supply a voltage of the second initialization power source Vint2 to the first electrode of the light emitting element LD.

When the voltage of the second initialization power source Vint2 is supplied to the first electrode of the light emitting element LD, a parasitic capacitor of the light emitting element LD may be discharged. As the residual voltage charged in the parasitic capacitor of the light emitting element LD is discharged (removed), a defect in which light is unintentionally finely emitted can be prevented. Accordingly, black expression capability of the pixel 10 can be improved.

The first initialization power source Vint1 and the second initialization power source Vint2 may generate different voltages. That is, a voltage for initializing the third node N3 and a voltage for initializing the fourth node N4 may be set differently.

In low-frequency driving where the length of one frame period is long, when the voltage of the first initialization power source Vint1 supplied to the third node N3 is too low, since a strong on-bias may be applied to the first transistor M1, a threshold voltage of the first transistor M1 may be shifted in a corresponding frame period. Such a hysteresis characteristic may cause a flicker phenomenon in the low-frequency driving. Accordingly, in the display device driven at a low frequency, the voltage of the first initialization power source Vint1 higher than a voltage of the second driving power source VSS may be required.

However, when the voltage of the second initialization power source Vint2 supplied to the fourth node N4 becomes higher than a predetermined reference, a voltage of the parasitic capacitor of the light emitting element LD may be charged rather than discharged. Accordingly, the voltage of the second initialization power source Vint2 should be lower than the voltage of the second driving power source VSS.

However, this is only an example, and the voltage of the first initialization power source Vint1 and the voltage of the second initialization power source Vint2 may be substantially the same.

The storage capacitor Cst may be connected between the first driving power source VDD and the third node N3. The storage capacitor Cst may store a voltage applied to the third node N3.

In an embodiment, the first transistor M1, the second transistor M2, the fourth transistor M4, the fifth transistor M5, the sixth transistor M6, and the eighth transistor M8 may be formed of polysilicon semiconductor transistors. For example, the first transistor M1, the second transistor M2, the fourth transistor M4, the fifth transistor M5, the sixth transistor M6, and the eighth transistor M8 may include a polysilicon semiconductor layer formed through a low temperature poly-silicon (LTPS) process as an active layer (channel). Also, the first transistor M1, the second transistor M2, the fourth transistor M4, the fifth transistor M5, the sixth transistor M6, and the eighth transistor M8 may be P-type transistors (for example, PMOS transistors). Accordingly, a gate-on voltage for turning on the first transistor M1, the second transistor M2, the fourth transistor M4, the fifth transistor M5, the sixth transistor M6, and the eighth transistor M8 may be a logic low level.

Since a polysilicon semiconductor transistor has an advantage of having a fast response speed, the polysilicon semiconductor transistor can be applied to a switching element requiring fast switching.

The third transistor M3 and the seventh transistor M7 may be formed of oxide semiconductor transistors. For example, the third transistor M3 and the seventh transistor M7 may be N-type oxide semiconductor transistors (for example, NMOS transistors), and may include an oxide semiconductor layer as an active layer. Accordingly, a gate-on voltage for turning on the third transistor M3 and the seventh transistor M7 may be at a logic high level.

An oxide semiconductor transistor can be manufactured by a low-temperature process, and may have lower charge mobility compared to the polysilicon semiconductor transistor. That is, the oxide semiconductor transistor may have excellent off-current characteristics. Accordingly, when the third transistor M3 and the seventh transistor M7 are formed of the oxide semiconductor transistors, leakage current from the second node N2 due to the low-frequency driving can be minimized, and thus display quality can be improved.

A parasitic capacitor Cpr may be formed between the emission control line Ei and the light emitting element LD (for example, the first electrode (anode) of the light emitting element LD). The parasitic capacitor Cpr may generate voltage coupling according to the transition of the emission control signal to a gate-off level (that is, a logic high level) during the non-emission period in which the current path to the light emitting element LD is blocked. Accordingly, in the non-emission period, a voltage of the first electrode of the light emitting element LD may be increased, the driving current supplied to the light emitting element LD may be increased instantaneously, and the luminance may be increased.

In particular, such a luminance increase phenomenon can be easily visually recognized in a low luminance image area.

Figure 4:
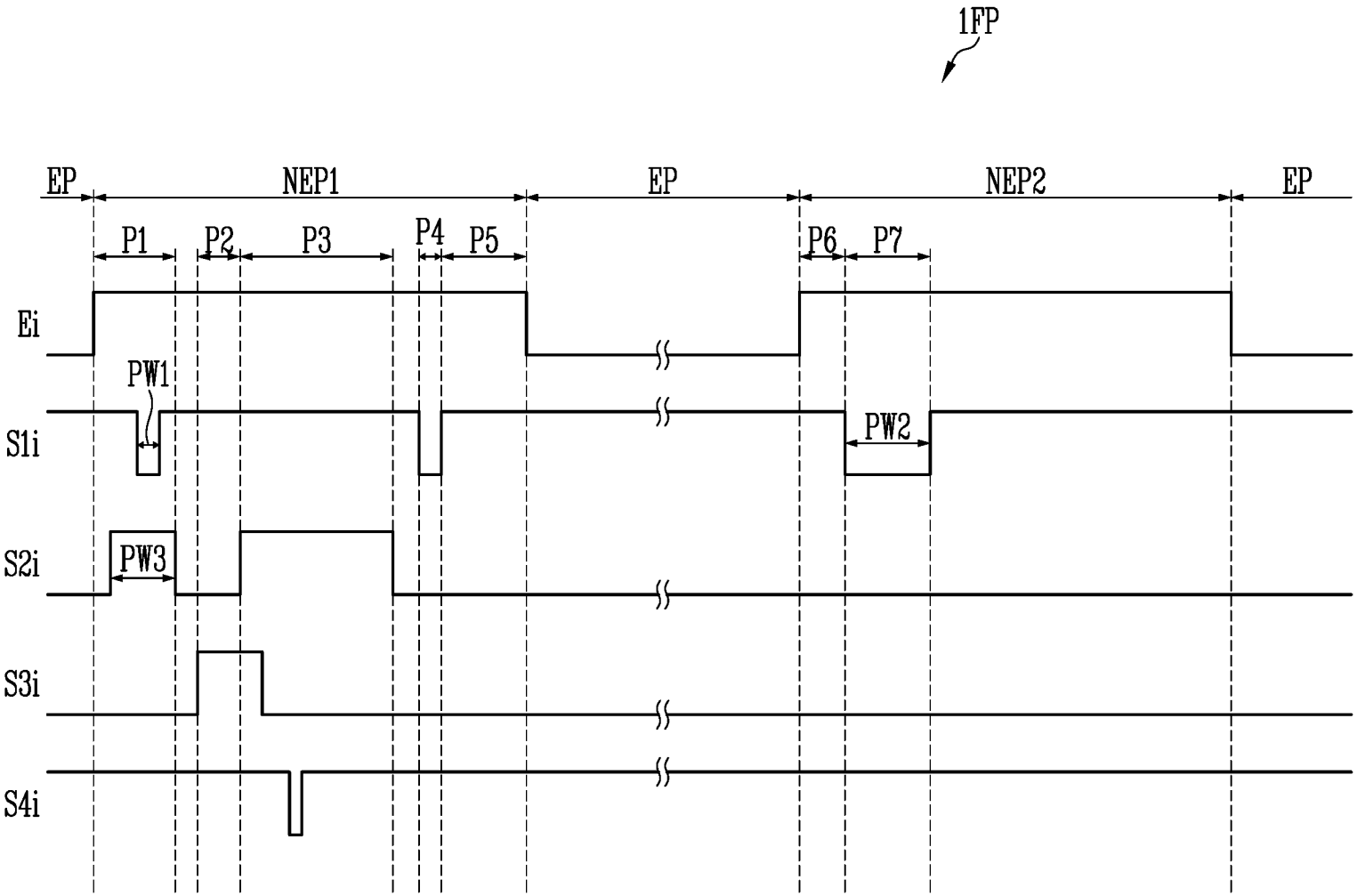
FIG. 4 is a timing diagram illustrating an example of signals supplied to the pixel in one frame period of FIG. 3.
Figure 5:
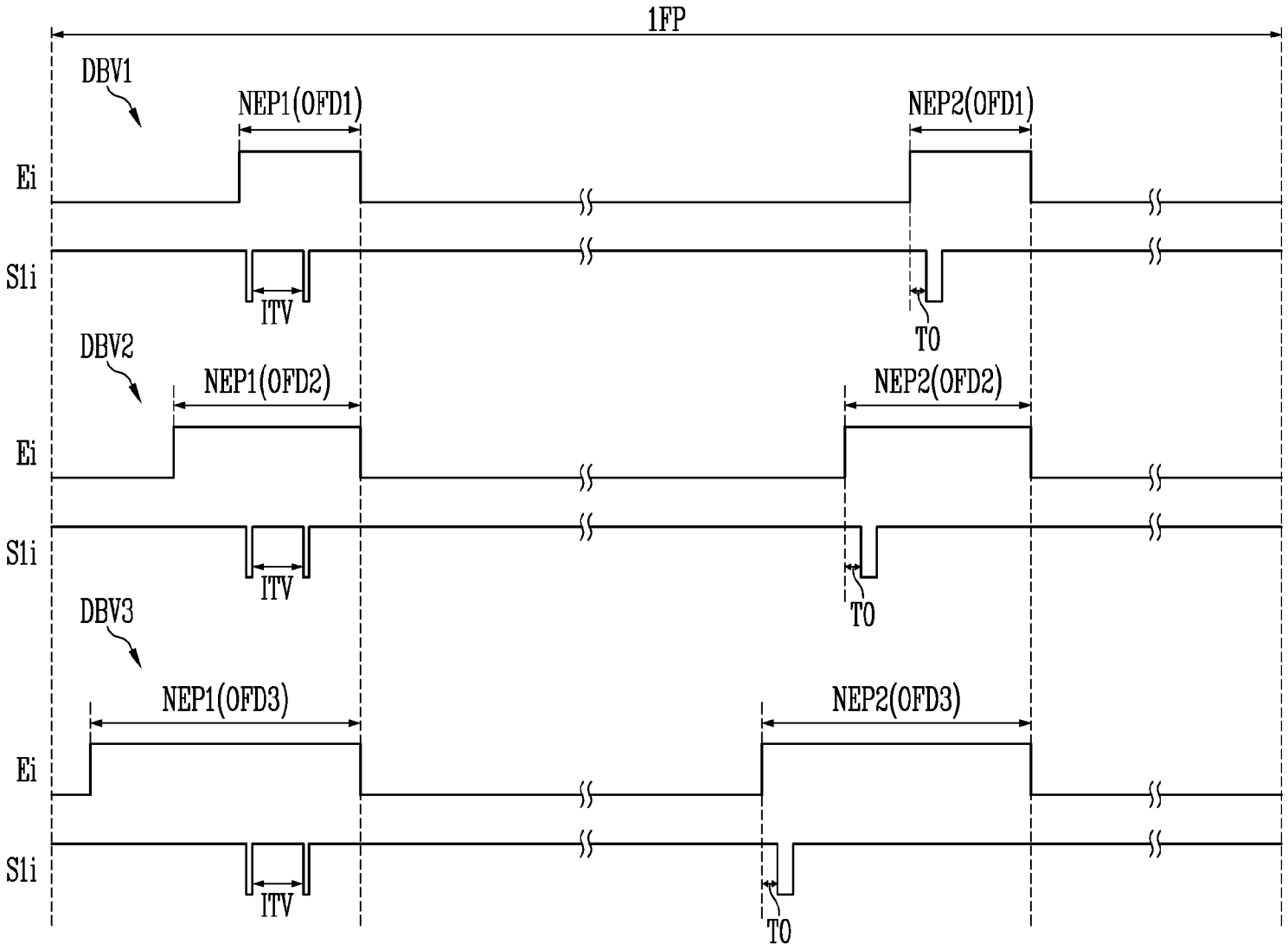
FIG. 5 is a timing diagram illustrating an example in which supply timings of an emission control signal and a first scan signal supplied in a frame period are controlled according to a dimming value.

FIG. 4 is a timing diagram illustrating an example of signals supplied to the pixel in a frame period of FIG. 3. FIG. 5 is a timing diagram illustrating an example in which supply timings of an emission control signal and a first scan signal supplied in a frame period are controlled according to a dimming value.

Referring to FIGS. 3, 4, and 5, a frame period 1FP may include an emission period EP, a first non-emission period NEP1, and a second non-emission period NEP2.

The emission period EP may be adjacent to each of the first non-emission period NEP1 and the second non-emission period NEP2. The first non-emission period NEP1 may be understood as the display scan period, and the second non-emission period NEP2 may be understood as the bias scan period.

FIG. 4 shows an embodiment in which one second non-emission period NEP2 is included in the frame period 1FP, the present invention is not limited thereto. For example, the frame period 1FP may include a plurality of second non-emission periods NEP2 (for example, bias scan periods) according to the driving frequency and/or setting of the display device 1000.

Here, the first non-emission period NEP1 (display scan period) may include a period in which the data signal actually corresponding to an output image is written. The second non-emission period NEP2 (bias scan period) may include a period in which the first transistor M1 is on-biased in response to the first scan signal.

As shown in FIG. 4, the emission control signal may be supplied a plurality of times during the frame period 1FP. That is, the emission control signal may have a first gate-off period and a second gate-off period corresponding to the first non-emission period NEP1 and the second non-emission period NEP2.

During the frame period 1FP, the third scan signal and the fourth scan signal may be supplied to the third scan line S3*i* and the fourth scan line S4*i* once, respectively.

In an embodiment, the second scan signal may be supplied to the second scan line S2*i* only during the first non-emission period NEP1. The second scan signal may be supplied to the second scan line S2*i* a plurality of times during the first non-emission period NEP1.

In an embodiment, the first scan signal may be supplied to the first scan line S1*i* during the first non-emission period NEP1 and the second non-emission period NEP2. The first scan signal may be supplied to the first scan line S1*i* a plurality of times during the first non-emission period NEP1.

The first scan signal may be a signal for controlling a bias state of the first transistor M1. For example, when the fourth transistor M4 is turned on by the first scan signal, the voltage of the first power source VEH may be supplied to the first node N1.

The display device according to the embodiments of the present invention may periodically apply the voltage of the first power source VEH to the source electrode of the first transistor M1 by using the fourth transistor M4. When the voltage of the first power source VEH is supplied to the source electrode of the first transistor M1, the first transistor M1 may be in the on-bias state, and the threshold voltage characteristic of the first transistor M1 may be changed. Accordingly, a phenomenon in which the characteristic of the first transistor M1 is fixed to a specific state in the low-frequency driving can be prevented from being deteriorated.

The gate-on voltages of the second scan signal and the third scan signal supplied to the third transistor M3 and the seventh transistor M7, which are N-type transistors, may be at the logic high level. The gate-on voltages of the fourth scan signal and the first scan signal supplied to the second transistor M2, the fourth transistor M4, and the eighth transistor M8, which are P-type transistors, may be at the logic low level.

In an embodiment, the first non-emission period NEP1 may include first to fifth periods P1 to P5.

In the first period P1, the scan driver 200 may supply the second scan signal to the second scan line S2*i* and supply the first scan signal to the first scan line S1*i*. In an embodiment, the first scan signal may be supplied after the second scan signal is supplied. Accordingly, in the first period P1, the fourth transistor M4 may be turned on after the third transistor M3 is turned on.

When only the fourth transistor M4 is turned on without the second scan signal being supplied, the voltage of the first power source VEH may be supplied to the first node N1 (that is, the source electrode of the first transistor M1). In this case, since the voltage of the first power source VEH is about 5V or more, the first transistor M1 may have the on-bias state. For example, the first transistor M1 may have a source voltage and a drain voltage of about 5V or more, and an absolute value of a gate-source voltage of the first transistor M1 may increase.

In this state, when the data signal is supplied by the supply of the fourth scan signal, the driving current may be unintentionally changed due to the influence of the bias state of the first transistor M1, and the luminance of the image may fluctuate (for example, the luminance may be increased).

To solve this problem, in the first period P1, the scan driver 200 may supply the second scan signal before the first scan signal. Accordingly, the third transistor M3 may be turned on before the fourth transistor M4. When the third transistor M3 is turned on, the second node N2 and the third node N3 may be electrically connected to each other. Thereafter, when the fourth transistor M4 is turned on, the voltage of the first power source VEH may be transferred to the third node N3 through the first node N1. For example, a voltage difference between the first node N1 and the third node N3 may be reduced to the same level as the threshold voltage of the first transistor M1. Accordingly, in the first period P1, the magnitude of the gate-source voltage of the first transistor M1 may be very small. For example, the first transistor M1 may be set to an off-bias state.

As such, to prevent an unintentional increase in luminance due to the supply of the voltage of the first power source VEH before writing the data signal in the first period P1, the supply of the first scan signal and the second scan signal may be controlled so that the fourth transistor M4 is turned on while the third transistor M3 is turned on.

In an embodiment, in the first period P1, the pulse width PW3 of the second scan signal may be greater than the pulse width PW1 of the first scan signal. For example, in the first period P1, the third transistor M3 may be turned on before the fourth transistor M4, and the third transistor M3 may be turned off after the fourth transistor M4 is turned off.

In addition, the eighth transistor M8 may be turned on in response to the first scan signal, and the voltage of the second initialization power source Vint2 may be supplied to the first electrode of the light emitting element LD (that is, the fourth node N4).

Thereafter, in the second period P2, the scan driver 200 may supply the third scan signal to the third scan line S3*i*. The seventh transistor M7 may be turned on by the third scan signal. When the seventh transistor M7 is turned on, the voltage of the first initialization power source Vint1 may be supplied to the gate electrode of the first transistor M1. That is, in the second period P2, the gate voltage of the first transistor M1 may be initialized based on the voltage of the first initialization power source Vint1. Accordingly, the strong on-bias may be applied to the first transistor M1, and the hysteresis characteristic may be changed (the threshold voltage may be shifted).

Thereafter, in the third period P3, the scan driver 200 may supply the second scan signal to the second scan line S2*i*. The third transistor M3 may be turned on again in response to the second scan signal. In the third period P3, the scan driver 200 may supply the fourth scan signal to the fourth scan line S4*i* to overlap a portion of the second scan signal. The second transistor M2 may be turned on by the fourth scan signal, and the data signal may be provided to the first node N1.

In this case, the first transistor M1 may be connected in the form of a diode by the turned-on third transistor M3, and data signal writing and threshold voltage compensation may be performed. Since the supply of the second scan signal is maintained even after the supply of the fourth scan signal is stopped, the threshold voltage of the first transistor M1 can be compensated for a sufficient time.

Thereafter, in the fourth period P4, the scan driver 200 may supply the first scan signal to the first scan line S1*i* again. Accordingly, the fourth transistor M4 and the eighth transistor M8 may be turned on. As the fourth transistor M4 is turned on, the voltage of the first power source VEH may be supplied to the first node N1.

The influence of the strong on-bias applied in the second period P2 may be removed by the data signal writing and the threshold voltage compensation. For example, a voltage difference between the gate voltage and the source voltage (and the drain voltage) of the first transistor M1 may be greatly reduced by the threshold voltage compensation in the third period P3. Then, the characteristic of the first transistor M1 may be changed again, and the driving current in the emission period EP may be increased or the black grayscale may be lifted.

To prevent such a change in characteristic, the fourth transistor M4 may be turned on in the fourth period P4. Accordingly, in the fourth period P4, the voltage of the first power source VEH may be supplied to the source electrode of the first transistor M1, so that the first transistor M1 may be set to the on-bias state.

Due to the operation in the fourth period P4, a sufficient time margin may be required between the fourth period P4 and the emission period EP to set the first transistor M1 to a stable on-bias state before light emitting. Accordingly, the fifth period P5 in which the scan signals are not supplied may be inserted between the fourth period P4 and the emission period EP.

In an embodiment, the fifth period P5 may be four or more horizontal periods. For example, the length of the fifth period P5 may be about 10 μm or more. Accordingly, the first transistor M1 may have the stable on-bias state before the emission period EP. Therefore, even when the emission period and the non-emission period are repeated, emission luminance can be maintained relatively stably.

In an embodiment, the first, second, third, and fourth scan signals may be supplied from the first, second, third, and fourth scan drivers 220, 240, 260, and 280 of FIG. 2, respectively.

In a seventh period P7 of the second non-emission period NEP2, the first scan signal may be supplied to the first scan line S1*i*. Accordingly, the voltage of the first power source VEH may be supplied to the source electrode of the first transistor M1 in the seventh period P7. That is, the on-bias may be periodically applied to the first transistor M1. Accordingly, a change in luminance of the first transistor M1 in the frame period 1FP can be minimized.

In an embodiment, the pulse width PW2 of the first scan signal supplied in the seventh period P7 may be greater than the pulse width PW1 of the first scan signal supplied in the first period P1. Accordingly, the voltage of the first power source VEH may be supplied to the source electrode of the first transistor M1 for a relatively sufficient time.

As described above, at a time point at which the second non-emission period NEP2 starts, the voltage coupling by the parasitic capacitor Cpr may occur according to the rise of the emission control signal. Accordingly, the voltage of the first electrode of the light emitting element LD (hereinafter, referred to as an anode voltage) may be increased, and the anode voltage may be maintained in an elevated state until the seventh period P7 in which the light emitting element LD is electrically connected to the fifth power source line PL5 again through the eighth transistor M8. Accordingly, an unintentional increase in luminance may occur in a sixth period P6.

In particular, when the length of the sixth period P6 is increased due to an increase in off-duty of the emission control signal according to the dimming signal DMS, a period during which the luminance increases may be prolonged. For example, a luminance reversal in which the luminance of an image in driving having a longer off-duty is higher than the luminance of an image in driving having a relatively short off-duty may occur.

As shown in FIG. 5, the frame period 1FP may include two non-emission periods (that is, gate-off periods of the emission control signal).

Off-duties OFD1, OFD2, and OFD3 of the emission control signal may be different according to dimming values DBV1, DBV2, and DBV3 included in the dimming signal DMS. Each of the dimming values DBV1, DBV2, and DBV3 may indicate the maximum display luminance that the display device 1000 may emit light.

For example, a first dimming value DBV1 may be greater than a second dimming value DBV2, and the second dimming value DBV2 may be greater than a third dimming value DBV3. In addition, the maximum display luminance indicated by the first dimming value DBV1 may be greater than the maximum display luminance indicated by the second dimming value DBV2, and the maximum display luminance indicated by the second dimming value DBV2 may be greater than the maximum display luminance indicated by the third dimming value DBV3. Accordingly, a first off-duty OFD1 may be smaller than a second off-duty OFD2, and the second off-duty OFD2 may be smaller than a third off-duty OFD3.

In an embodiment, the first scan signal supplied to the first scan line S1*i* in the first non-emission period NEP1 may be supplied at a constant time point regardless of changes in dimming values DBV1, DBV2, and DBV3. Also, an interval ITV between first scan signals supplied in the first non-emission period NEP1 may be constant regardless of the changes in dimming values DBV1, DBV2, and DBV3.

In addition, the second scan signal, the third scan signal, and the fourth scan signal respectively supplied to the second scan line S2*i*, the third scan line S3*i*, and the fourth scan line S4*i* may be supplied at a constant time point regardless of the changes in dimming values DBV1, DBV2, and DBV3.

In an embodiment, within each frame period 1FP of the same driving frequency, an end time point of the first non-emission period NEP1 with respect to the first off-duty OFD1, an end time point of the first non-emission period NEP1 with respect to the second off-duty OFD2, and an end time point of the first non-emission period NEP1 with respect to the third off-duty OFD3 may all be substantially the same. Similarly, an end time point of the second non-emission period NEP2 with respect to the first off-duty OFD1, an end time point of the second non-emission period NEP2 with respect to the second off-duty OFD2, and an end time point of the second non-emission period NEP2 with respect to the third off-duty OFD3 may all be substantially the same.

In other words, within each frame period 1FP of the same driving frequency, start time points of the first and second non-emission periods NEP1 and NEP2 may be changed according to the change in off-duty. For example, as shown in FIG. 5, as the off-duty increases, the start time point of each of the first and second non-emission periods NEP1 and NEP2 may be earlier.

When the first scan signal is supplied at a constant timing regardless of the off-duty of the emission control signal in the second non-emission period NEP2, the length of the sixth period P6 may be increased due to an increase in off-duty, and the luminance reversal may occur in a predetermined luminance range. In an embodiment, in order to improve this problem, the controller 500 may determine a supply time point of the first scan signal in conjunction with the start time point of the second non-emission period NEP2.

In an embodiment, a time interval (that is, the sixth period P6) between the start time point of the second non-emission period NEP2 and the supply time point of the first scan signal in the second non-emission period NEP2 may be constant at a predetermined interval TO. The start time point of the second non-emission period NEP2 may be a time point at which the emission control signal transitions from the gate-on voltage to the gate-off voltage. The supply time point of the first scan signal may be a time point at which the first scan signal transitions from the gate-off voltage to the gate-on voltage.

In other words, as shown in FIG. 5, as the off-duty increases, an output timing of the first scan signal in the second non-emission period NEP2 of the frame period 1FP may be accelerated. Also, as the off-duty increases, a time interval between the supply time point of the first scan signal in the second non-emission period NEP2 and the end time point of the second non-emission period NEP2 may be increased. The end time point of the second non-emission period NEP2 may be a time point at which the emission control signal transitions from the gate-off voltage to the gate-on voltage.

As described above, by adjusting the output timing of the first scan signal in the second non-emission period NEP2 according to the change in off-duty of the emission control signal, the length of the sixth period P6 may be constantly maintained despite the change in off-duty. Therefore, in the dimming driving for controlling the off-duty of the emission control signal, distortion of luminance due to coupling of the parasitic capacitor Cpr between the emission control line Ei and the first electrode (anode) of the light emitting element LD may be improved, and the image quality can be improved.

Figure 6:
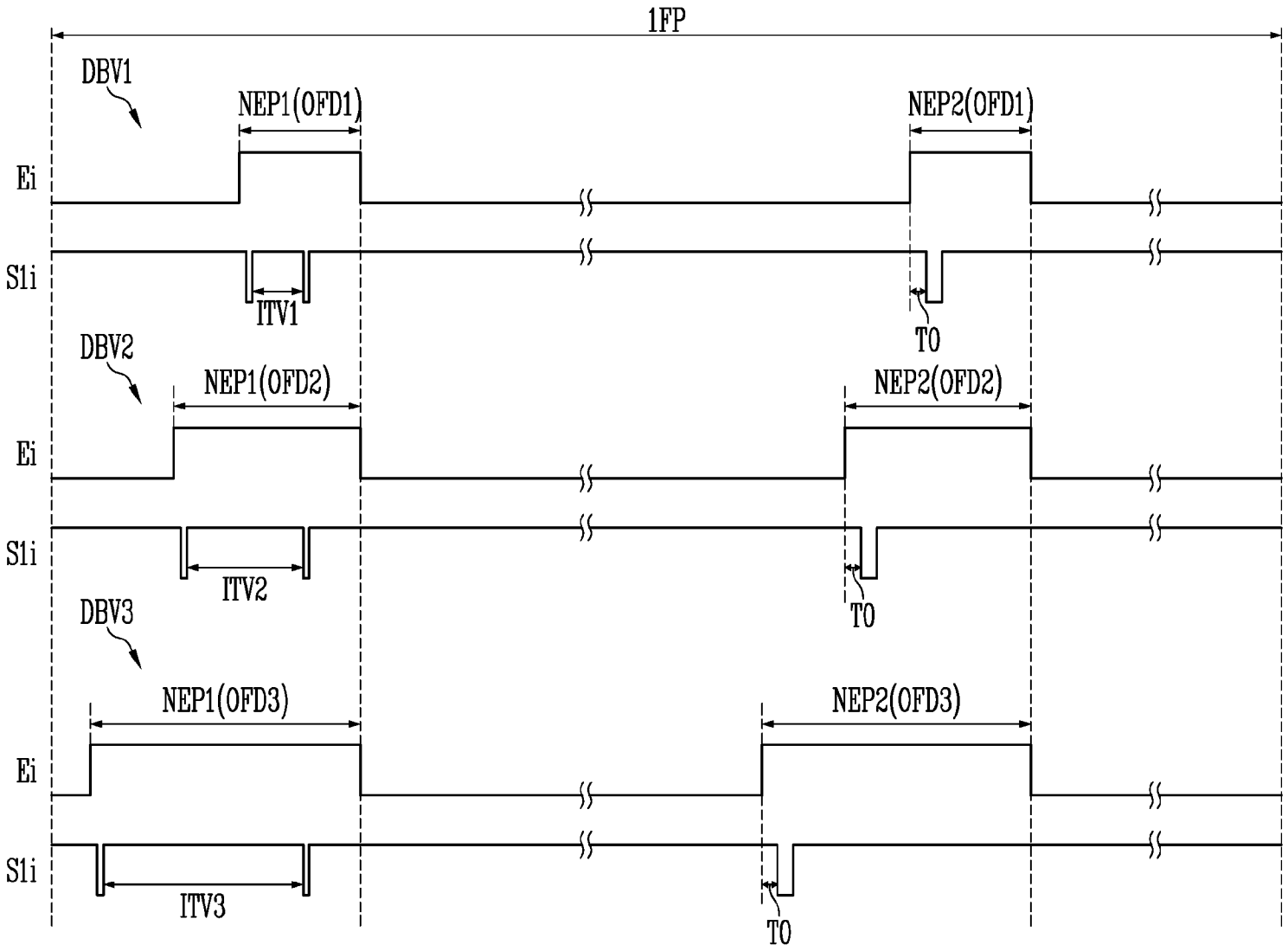
FIG. 6 is a timing diagram illustrating an example in which supply timings of an emission control signal and a first scan signal supplied in a frame period are controlled according to a dimming value.

FIG. 6 is a timing diagram illustrating an example in which supply timings of an emission control signal and a first scan signal supplied in a frame period are controlled according to a dimming value.

The timing diagram of FIG. 6 may be substantially the same as the operation described with reference to FIG. 5, except for the supply timing of the first scan signal in the first non-emission period NEP1. Therefore, the same reference numerals are used for the same or corresponding components, and duplicate descriptions will be omitted for sake of brevity.

Referring to FIGS. 4 and 6, as the off-duty increases, an interval at which the first scan signal is supplied in the first non-emission period NEP1 may be increased.

In response to the first dimming value DBV1, the first scan signals may be supplied at a first interval ITV1 in the first non-emission period NEP1. In response to the second dimming value DBV2, the first scan signals may be supplied at a second interval ITV2 in the first non-emission period NEP1. In response to the third dimming value DBV3, the first scan signals may be supplied at a third interval ITV3 in the first non-emission period NEP1. The second interval ITV2 may be greater than the first interval ITV1 and smaller than the third interval ITV3.

In an embodiment, the first scan signal output in the first period P1 based on the second dimming value DBV2 and the third dimming value DBV3 may be output before the second scan signal.

Figure 7:
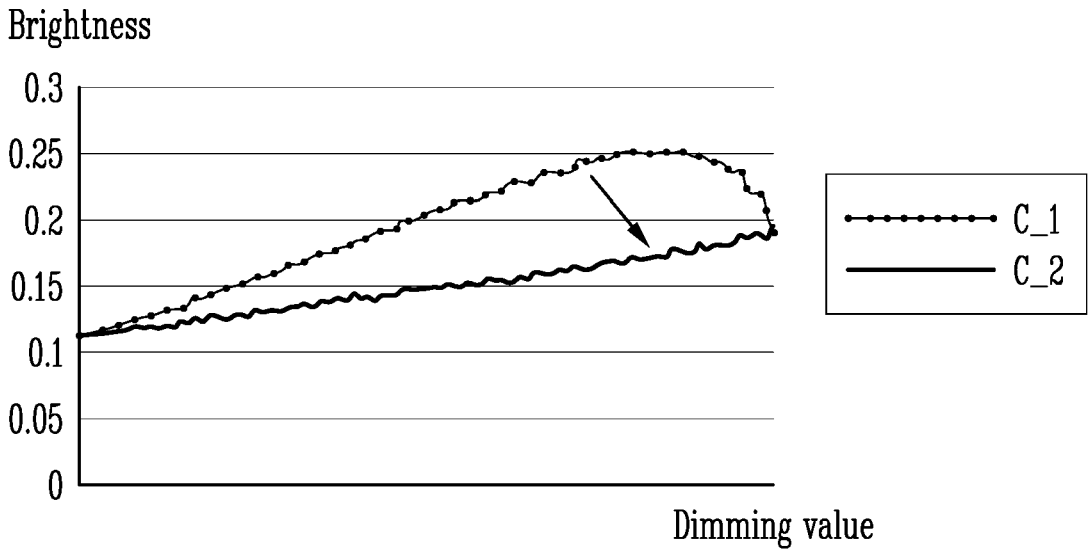
FIG. 7 is a diagram illustrating an effect of improving distortion of luminance according to a dimming value by the operation described with reference to FIGS. 5 and 6.

FIG. 7 is a diagram illustrating an effect of improving distortion of luminance according to a dimming value by the operation described with reference to FIGS. 5 and 6.

Referring to FIGS. 5, 6, and 7, the off-duty and luminance of the emission control signal may be controlled according to the dimming value.

Theoretically, when the dimming value is increased, the luminance must be increased by decreasing the off-duty. FIG. 7 shows a result of measuring a change in luminance according to a change in dimming value with respect to the same grayscale value (for example, the data voltage).

The first curve C_1 shows a luminance curve with respect to a dimming value according to the prior art. That is, a section in which the luminance is reversed (distorted) by the coupling of the parasitic capacitor Cpr between the emission control line Ei and the first electrode (anode) of the light emitting element LD may exist.

However, as described with reference to FIGS. 5 and 6, a luminance curve such as the second curve C_2 may be obtained by adjusting the output timing of the first scan signal in the second non-emission period NEP2. That is, the luminance may be increased in proportion to the increase in the dimming value. That is, the first curve C_1 can be improved like the second curve C_2.

Figure 8:
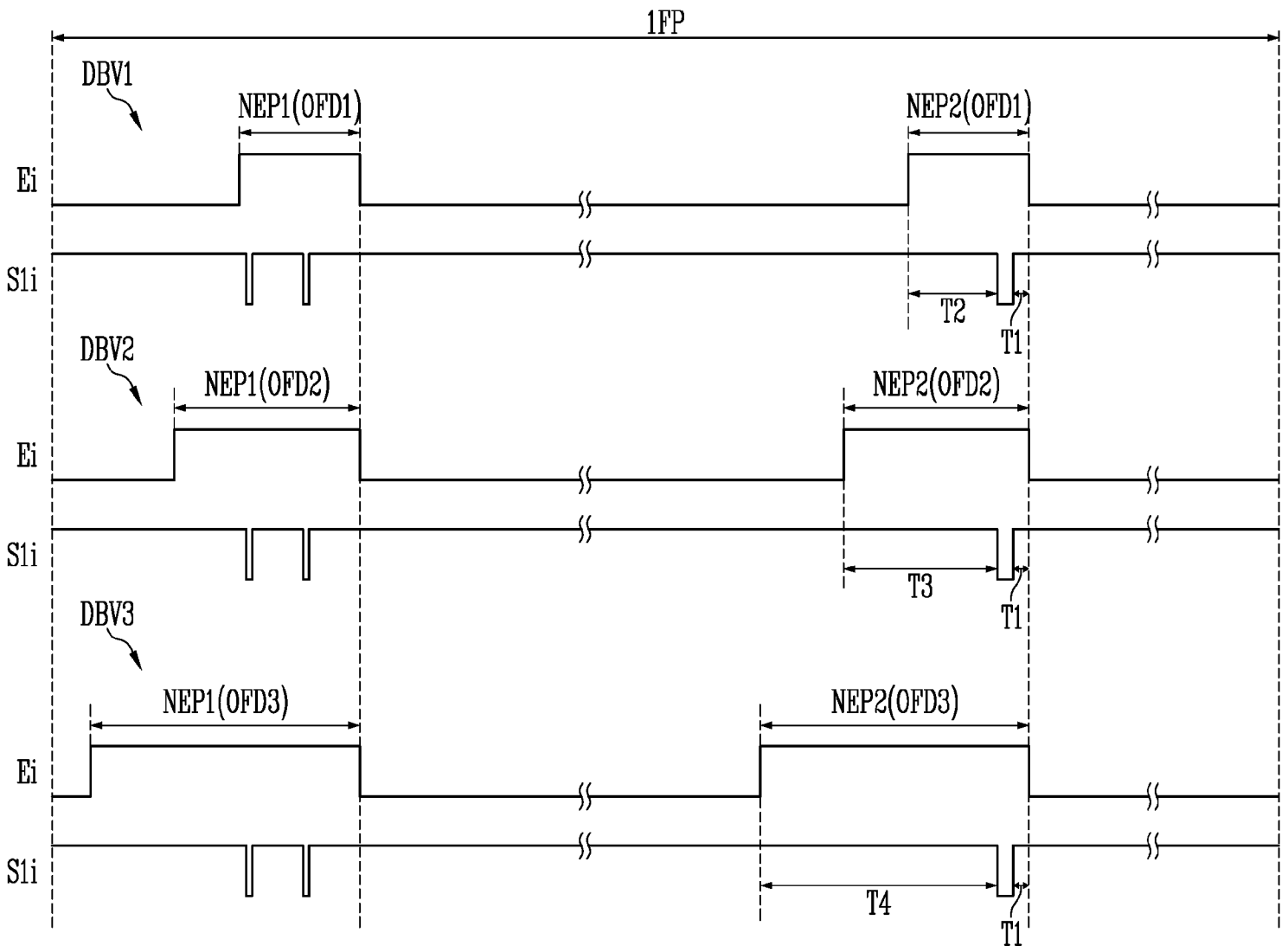
FIG. 8 is a timing diagram illustrating an example in which supply timings of an emission control signal and a first scan signal supplied in a frame period are controlled according to a dimming value.
Figure 9:
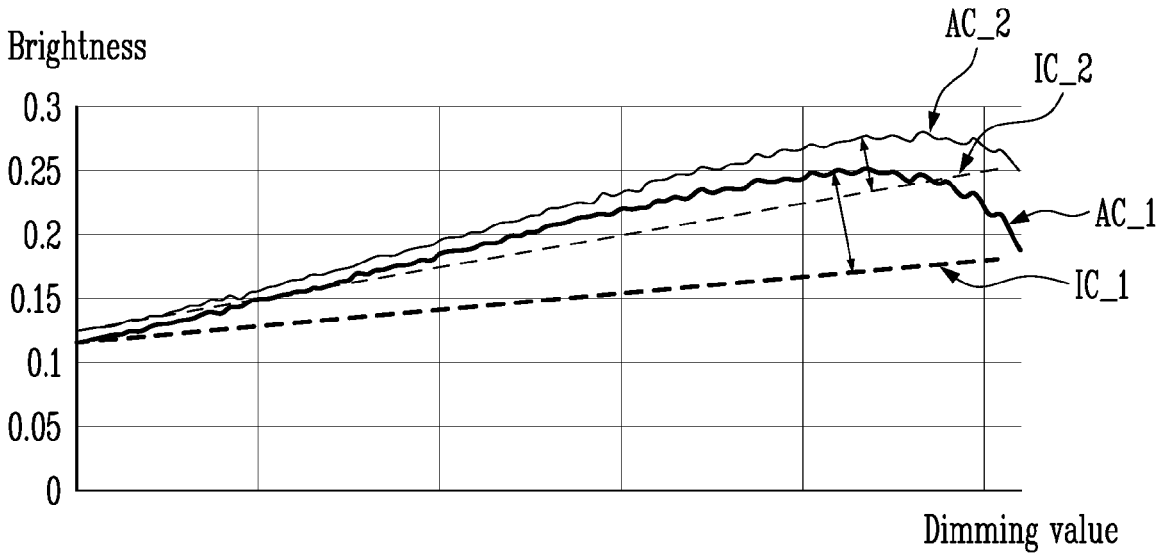
FIG. 9 is a diagram illustrating an effect of improving distortion of luminance according to a dimming value by the operation described with reference to FIG. 8.

FIG. 8 is a timing diagram illustrating an example in which supply timings of an emission control signal and a first scan signal supplied in a frame period are controlled according to a dimming value. FIG. 9 is a diagram illustrating an effect of improving distortion of luminance according to a dimming value by the operation described with reference to FIG. 8.

Referring to FIGS. 3, 4, 8, and 9, a first time interval T1 between the end time point of the second non-emission period NEP2 and the supply time point of the first scan signal in the second non-emission period NEP2 may be constant.

In an embodiment, as the off-duty increases, the time interval (that is, the length of the sixth period P6) between the start time point of the second non-emission period NEP2 and the supply time point of the first scan signal may be increased. For example, the sixth period P6 may correspond to a second time interval T2 by the first dimming value DBV1, the sixth period P6 may correspond to a third time period T3 by the second dimming value DBV2, and the sixth period P6 may correspond to a fourth time interval T4 by the third dimming value DBV3. The third time interval T3 may be greater than the second time interval T2 and smaller than the fourth time interval T4. The length of the sixth period P6 may be at least about 100 μs. In addition, the first time interval T1 may be much shorter than the length of the sixth period P6. For example, the length of the sixth period P6 may be 5 times or more of the first time interval T1.

That is, the purpose of the operation according to the embodiment of FIG. 8 is to alleviate a deviation in luminance caused by the parasitic capacitor Cpr due to the change in off-duty by sufficiently securing the length of the sixth period P6. For example, by sufficiently securing the second to fourth time intervals T2, T3, and T4, a deviation in luminance increase in the sixth period P6 corresponding to the first to third dimming values DBV1, DBV2, and DBV3 may be reduced. In this case, since it is not necessary to control the timing of the first scan signal according to the dimming value, there may be advantages in terms of manufacturing cost, power consumption, and driving algorithm.

Specifically, the first curve IC_1 and the second curve IC_2 of FIG. 9 show a theoretical change in luminance. The second curve IC_2 may correspond to the supply of the first scan signal in the second non-emission period NEP2 as shown in FIG. 8. The first curve IC_1 shows an example in which the first scan signal is supplied earlier than the case of the second curve IC_2 in the second non-emission period NEP2.

Considering the anode coupling of the light emitting element LD by the parasitic capacitor Cpr, the first actual curve AC_1 may be greatly affected by the deviation in the length of the sixth period P6. However, the second actual curve AC_2 according to the operation of the embodiments of the present invention may show a more linear change in luminance compared to the first actual curve AC_1. In this way, by sufficiently securing the length of the sixth period P6 affecting the voltage coupling by the parasitic capacitor Cpr and the increase in luminance so that the influence by the coupling is negligible, the manufacturing cost and power consumption can be reduced, and the distortion of luminance due to the change in off-duty can be alleviated.

Figure 10:
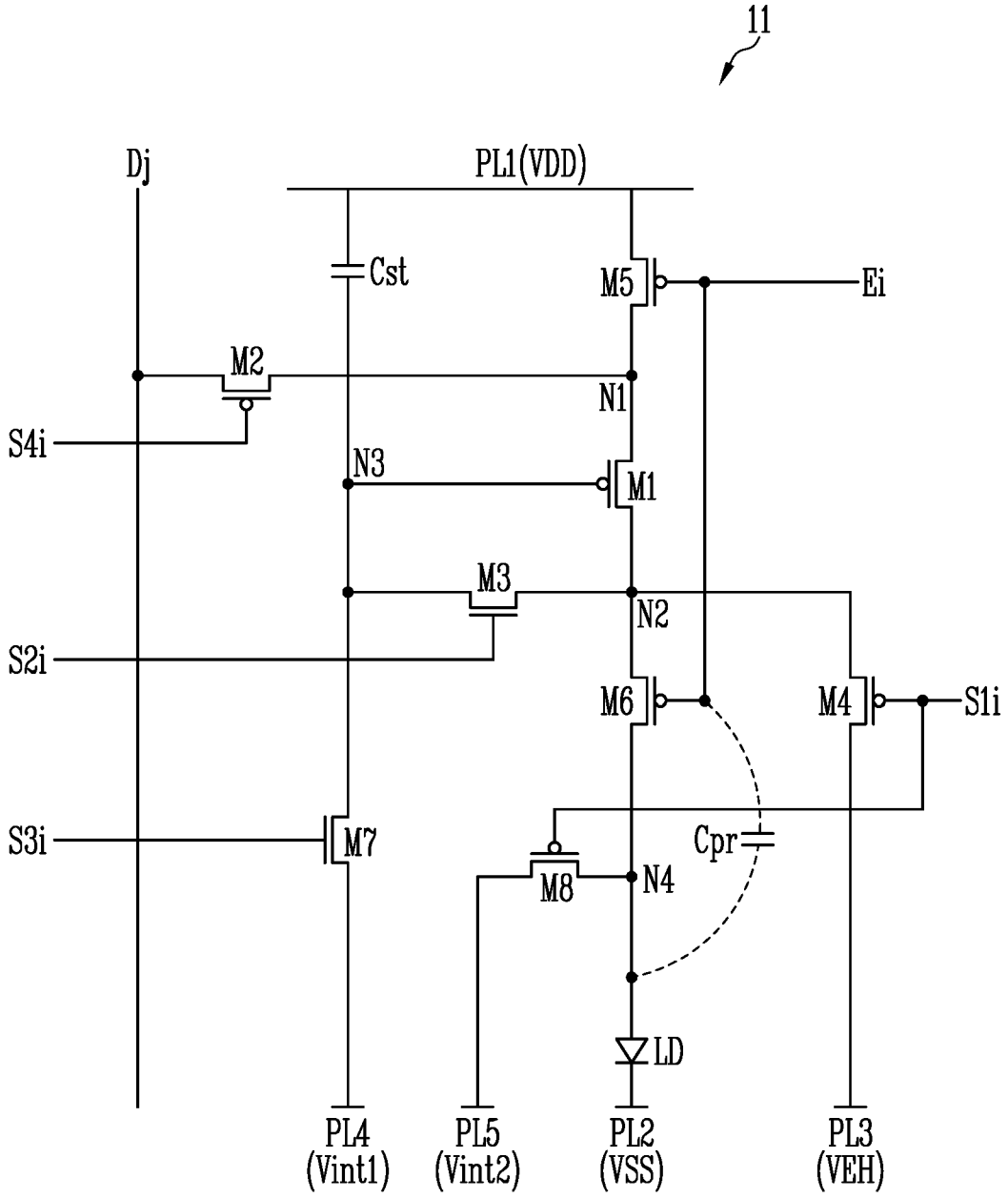
FIG. 10 is a circuit diagram illustrating an example of a pixel included in the display device of FIG. 1.

FIG. 10 is a circuit diagram illustrating an example of a pixel included in the display device of FIG. 1.

A pixel 11 of FIG. 10 may have the same configuration and operation as the pixel 10 described with reference to FIG. 3, except for the fourth transistor M4. Therefore, the same reference numerals are used for the same or corresponding components, and duplicate descriptions will be omitted for sake of brevity.

Referring to FIG. 10, the pixel 11 may include a light emitting element LD, first to eighth transistors M1 to M8, and a storage capacitor Cst.

In an embodiment, one electrode of the fourth transistor M4 may be connected to the second node N2, and the other electrode may be connected to the third power source line PL3 through which the first power source VEH is transmitted. The fourth transistor M4 may supply the voltage of the first power source VEH to the second node N2 in response to the first scan signal supplied to the first scan line S1*i*. As described above, a voltage for on-bias may be supplied to any one of the source electrode and the drain electrode of the first transistor M1.

In an embodiment, the other electrode of the fourth transistor M4 may be connected to the emission control line Ei instead of the first power source VEH. When the fourth transistor M4 is turned on, the logic high level of the emission control signal may be supplied to the second node N2.

As described above, according to the display device for controlling the off-duty of the emission control signal and the method of driving the same according to the embodiments of the present invention, by controlling the output timing of the first scan signal in the second non-emission period, the distortion of luminance due to the voltage coupling by the parasitic capacitor Cpr between the emission control line Ei and the first electrode (anode) of the light emitting element LD can be improved, and the image quality can be improved.

Although certain embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a pixel that includes a first transistor connected between a first node and a second node to generate a driving current, the pixel connected to a first scan line, a second scan line, a third scan line, a fourth scan line, an emission control line, and a data line;

an emission driver configured to supply an emission control signal having an off-duty corresponding to a first gate-off period and a second gate-off period to the emission control line during a frame period, the first gate-off period corresponding to a first non-emission period and the second gate-off period corresponding to a second non-emission period;

a scan driver configured to supply first, second, third, and fourth scan signals to the first, second, third, and fourth scan lines in the first non-emission period, respectively, and to supply the first scan signal to the first scan line in the second non-emission period;

a data driver configured to supply a data signal to the data line; and a controller configured to control adjusting of the off-duty of the emission control signal that is a width of each of the first and second non-emission periods in response to a dimming signal, and to control a timing at which the first scan signal is supplied in the second non-emission period.

2. The display device of claim 1, wherein the dimming signal includes a dimming value indicating a maximum display luminance that the display device can emit light, and wherein the maximum display luminance increases and the off-duty decreases as the dimming value increases.

3. The display device of claim 2, wherein the controller is configured to determine a supply time point of the first scan signal in conjunction with a start time point of the second non-emission period.

4. The display device of claim 3, wherein a time interval between the start time point of the second non-emission period and the supply time point of the first scan signal in the second non-emission period is substantially constant.

5. The display device of claim 4, wherein an output timing of the first scan signal in the second non-emission period of the frame period becomes earlier as the off-duty increases.

6. The display device of claim 4, wherein within each frame period of the same driving frequency, an end time point of the second non-emission period with respect to a first off-duty is substantially the same as an end time point of the second non-emission period with respect to a second off-duty, and an end time point of the first non-emission period with respect to the first off-duty is substantially the same as an end time point of the first non-emission period with respect to the second off-duty.

7. The display device of claim 4, wherein a time interval between the supply time point of the first scan signal in the second non-emission period and the end time point of the second non-emission period increases as the off-duty increases.

8. The display device of claim 3, wherein the pixel further comprises:

a light emitting element;

a second transistor connected between the data line and the first node and turned on in response to the fourth scan signal supplied to the fourth scan line;

a third transistor connected between the second node and a third node connected to a gate electrode of the first transistor and turned on in response to the second scan signal supplied to the second scan line;

a fourth transistor turned on in response to the first scan signal supplied to the first scan line to apply a voltage of a first power source to the first transistor;

a fifth transistor connected between a driving power source and the first node and turned off during the first and second gate-off periods of the emission control signal supplied to the emission control line; and a sixth transistor connected between the second node and a first electrode of the light emitting element and turned off during the first and second gate-off periods of the emission control signal supplied to the emission control line.

9. The display device of claim 8, wherein in the first non-emission period, the scan driver supplies the first scan signal and the second scan signal to the first scan line and the second scan line a plurality of times, respectively.

10. The display device of claim 9, wherein a pulse width of the first scan signal supplied in the second non-emission period is greater than a pulse width of the first scan signal supplied in the first non-emission period.

11. The display device of claim 9, wherein an interval at which the first scan signal is supplied in the first non-emission period increases as the off-duty increases.

12. The display device of claim 8, wherein the pixel further comprises:

a seventh transistor connected between the third node and a second power source and turned on in response to the third scan signal supplied to the third scan line; and an eighth transistor connected between the first electrode of the light emitting element and a third power source and turned on in response to the first scan signal.

13. The display device of claim 12, wherein the scan driver is configured to supply the second scan signal to the second scan line in a first period and a third period of the first non-emission period, and to supply the third scan signal to the third scan line in a second period of the first non-emission period, and wherein the second period begins between the first period and the third period.

14. The display device of claim 13, wherein the scan driver supplies the fourth scan signal to the fourth scan line to overlap a portion of the second scan signal in the third period.

15. The display device of claim 14, wherein the scan driver is configured to supply the first scan signal to the first scan line in the first period and a fourth period after the third period.

16. The display device of claim 15, wherein after the fourth period, the supply of the first, second, third, and fourth scan signals is stopped during a remaining period of the first non-emission period, and wherein a length of the remaining period is greater than a width of the first scan signal.

17. The display device of claim 2, wherein a first time interval between an end time point of the second non-emission period and a supply time point of the first scan signal in the second non-emission period is substantially constant, wherein a second time interval between a start time point of the second non-emission period and the supply time point of the first scan signal in the second non-emission period increases as the off-duty increases, and wherein the second time interval is greater than the first time interval.

18. The display device of claim 2, wherein the scan driver comprises:

a first scan driver configured to supply the first scan signal to the first scan line in the first non-emission period and the second non-emission period;

a second scan driver configured to supply the second scan signal to the second scan line a plurality of times in the first non-emission period;

a third scan driver configured to supply the third scan signal to the third scan line between supplies of the second scan signal in the first non-emission period; and a fourth scan driver configured to supply the fourth scan signal to the fourth scan line to overlap a portion of the second scan signal.

19. A method of driving a display device including a first non-emission period and a second non-emission period during a frame period, the method comprising:

determining an off-duty of an emission control signal that is a width of each of the first non-emission period and the second non-emission period based on a dimming value included in a dimming signal;

supplying first, second, third, and fourth scan signals to first, second, third, and fourth scan lines in the first non-emission period, respectively, and writing a data signal; and supplying the first scan signal to the first scan line within the second non-emission period in conjunction with a start time point of the second non-emission period.

20. The method of claim 19, wherein a time interval between the start time point of the second non-emission period and a supply time point of the first scan signal in the second non-emission period is substantially constant, and wherein an output timing of the first scan signal in the second non-emission period of the frame period becomes earlier as the off-duty increases.

* * * * *